US007086354B2

(12) United States Patent
Dunbar et al.

(10) Patent No.: US 7,086,354 B2
(45) Date of Patent: Aug. 8, 2006

(54) COOLING NOZZLE MOUNTING ARRANGEMENT

(75) Inventors: Stephen Leo Dunbar, Waterloo, IA (US); Paul Michael Wynthein, Waterloo, IA (US); Larry Linn Kriener, Waterloo, IA (US); Mark Ashley Sanborn, Waterloo, IA (US); Mohammed Akbar Qureshi, Elk Grove Village, IL (US)

(73) Assignee: Deere & Company, Moline, IL (US)

( * ) Notice: Subject to any disclaimer, the term of this patent is extended or adjusted under 35 U.S.C. 154(b) by 45 days.

(21) Appl. No.: 10/697,749

(22) Filed: Oct. 29, 2003

(65) Prior Publication Data

US 2005/0092265 A1 May 5, 2005

(51) Int. Cl.
*F01P 1/04* (2006.01)

(52) U.S. Cl. ..... 123/41.35

(58) Field of Classification Search ..... 123/41.35
See application file for complete search history.

(56) References Cited

U.S. PATENT DOCUMENTS 4,901,679 A * 2/1990 Hodgkins et al. ..... 123/41.35
5,081,959 A 1/1992 Akiyama (Continued)

FOREIGN PATENT DOCUMENTS

EP 0 346 264 6/1989
WO WO 80/02308 4/1979

(Continued)

OTHER PUBLICATIONS

Schwarz R et al: "Optimierungh Von Olspritzduesen Zur Kolbenkuehling" MTZ Motortechnische Zeitschrift Franchkh'sche Verlagshandlung, Abteilung Technik. Stuttgart, DE, vol. 62, No. 3, Mar. 2001.

*Primary Examiner*—Noah P. Kamen

(57) ABSTRACT

A cooling nozzle assembly includes a mounting plate, a pin body and a nozzle tube. The mounting plate has a pin aperture and a fastener aperture. The pin body has a head portion and a shaft portion. The shaft portion of the pin body has a blind bore that extends from an open first end of the shaft portion to the head portion. The shaft portion of the pin body is fitted into the pin aperture of the plate and affixed to the plate. A hole is cross-drilled in the assembly to intersect the blind bore of the shaft portion of the pin body. The nozzle has an interior passage. The nozzle tube is mounted to the plate and pin body assembly by fitting it into the hole. The interior passage is in fluid communication with the blind bore of the pin body. An engine cylinder block includes a cylinder with a piston assembly disposed therein. A mounting surface is provided in the cylinder block for mounting the cooling nozzle assembly proximal to the cylinder. The mounting surface is provided with a pin aperture that intersects with the oil gallery passage of the cylinder block. A fastener aperture is also provided in the mounting surface and is tapped to receive a conventional threaded fastener. The nozzle assembly is mounted to the cylinder block such that the shaft portion of the pin body is disposed in the pin aperture. Thus the blind bore of the shaft portion and the interior passage of the tube are in fluid communication with the oil gallery passage of the cylinder block. The fastener serves both to secure the nozzle assembly to the cylinder block and, in conjunction with the pin body, maintain the radial position of the nozzle assembly in the cylinder block. Accordingly, the nozzle tube is disposed such that the flow of oil is directed to the appropriate areas of the piston.

1 Claim, 5 Drawing Sheets

U.S. PATENT DOCUMENTS 5,845,611 A * 12/1998 Schmidt et al. ..... 123/41.35
6,298,810 B1 10/2001 Chimonides et al.
6,526,871 B1 3/2003 Zhu et al.
6,672,262 B1 1/2004 Bontaz
2002/0139322 A1 10/2002 Murglin
2004/0040520 A1 3/2004 Bontaz et al.

* cited by examiner

COOLING NOZZLE MOUNTING ARRANGEMENT

FIELD OF THE INVENTION

The present invention relates generally to internal combustion engines. More particularly, the present invention relates to systems for cooling and lubricating pistons in internal combustion engines. Specifically, the present invention relates to a mounting arrangement for a piston cooling nozzle.

BACKGROUND OF THE INVENTION

Previously it has been known to use cooling nozzles in internal combustion engines to direct a spray of oil to the underside of the pistons for the purpose of cooling and/or lubrication. Typically such nozzles are mounted to the cylinder block and have some means for communicating with the oil gallery of the engine. One known type of cooling nozzle is a cartridge style arrangement that is inserted in a through-bore from outside the cylinder block. The through-bore intersects the oil gallery and an orifice on the cartridge communicates oil from the gallery to the nozzle. This arrangement requires o-rings to prevent oil leakage. Also the length to diameter ratio of the nozzle is limited due to the requirements for mounting the nozzle via the through-bore. Another type of nozzle mounting arrangement is disclosed in U.S. Pat. No. 6,298,810 to Chimonides et al. This nozzle consists of an annular mounting collar having a cylindrical outer surface and a tube projecting generally radially from the mounting collar. The engine block is formed with a drilled and tapped screw threaded bore that is drilled into the surface of the engine block to intersect the oil gallery. A special capscrew is inserted through the collar into the threaded bore to retain the collar to the cylinder block. The capscrew has special machining to allow oil to flow from the oil gallery to the nozzle. A locating pin is provided to maintain the radial position of the nozzle.

New piston configurations such as the monobloc design disclosed in U.S. Pat. No. 6,526,871 to Zhu et al. require cooling and lubrication in the under-crown area, however such monobloc designs have cooling galleries that are typically accessible only through one or two holes in the under-crown of the piston. Because it is necessary to direct a flow of oil to these access holes, existing nozzle designs cannot be used.

Accordingly, there is a clear need in the art for a cooling nozzle mounting arrangement which allows for internal centrally located mounting, has a longer nozzle, and provides intermittent flow without the need for special screws and/or o-rings.

SUMMARY OF THE INVENTION

In view of the foregoing, it is an object of the invention to provide a cooling nozzle for directing a flow of oil to a piston in an internal combustion engine.

Another object of the invention is the provision of such a cooling nozzle which can be centrally located within the cylinder block for easy access.

A further object of the invention is to provide a cooling nozzle mounting arrangement which permits the use of a longer nozzle, and can provide intermittent flow without the need for special mounting screws and/or o-rings.

An additional object of the invention is the provision of such a cooling nozzle mounting arrangement which is inexpensive to produce and is compatible with known manufacturing and assembly techniques and equipment.

The foregoing and other objects of the invention together with the advantages thereof over the known art which will become apparent from the detailed specification which follows are attained by a cooling nozzle mounting arrangement comprising: a cooling nozzle assembly comprised of: a mounting plate having a pin aperture located proximal to a first end of the plate and a fastener aperture located proximal to a second end of the plate; a pin body having a head portion and a shaft portion, the shaft portion of the pin body having a blind bore that extends from an open first end of the shaft portion to the head portion wherein the shaft portion of the pin body is fitted into the pin aperture of the plate and affixed to the plate and a hole is cross-drilled in the assembly so as to intersect the blind bore of the shaft portion of the pin body; a nozzle tube having an interior passage wherein the nozzle tube is mounted to the plate and pin body assembly by fitting a part of the nozzle tube into the hole such that the interior passage is in fluid communication with the blind bore of the pin body; an engine cylinder block comprised of: a cylinder with a piston assembly disposed therein, the piston assembly including a piston and a connecting rod; a mounting surface in the cylinder block for mounting the cooling nozzle assembly proximal to the cylinder, the mounting surface having a fastener aperture and a pin aperture that intersects with an oil gallery passage of the cylinder block, wherein the nozzle assembly is mounted to the cylinder block by a fastener that engages both the fastener aperture of the mounting plate and the fastener aperture of the cylinder block such that the shaft portion of the pin body is disposed in the pin aperture so that the blind bore of the shaft portion and the interior passage of the tube are in fluid communication with the oil gallery passage of the cylinder block.

Other objects of the invention are attained by a cooling nozzle assembly for directing a flow of oil to a piston in a cylinder block comprising: a mounting plate having a pin aperture located proximal to a first end of the plate and a fastener aperture located proximal to a second end of the plate; a pin body having a head portion and a shaft portion, the shaft portion of the pin body having a blind bore that extends from an open first end of the shaft portion to the head portion wherein the shaft portion of the pin body is fitted into the pin aperture of the plate and affixed to the plate and a hole is cross-drilled in the assembly so as to intersect the blind bore of the shaft portion of the pin body; and, a nozzle tube having an interior passage wherein the nozzle tube is mounted to the plate and pin body assembly by fitting a part of the nozzle tube into the hole such that the interior passage is in fluid communication with the blind bore of the pin body; wherein the nozzle assembly is mounted to the cylinder block by a fastener that engages both the fastener aperture of the mounting plate and a fastener aperture of the cylinder block such that the shaft portion of the pin body is disposed in a pin aperture of the cylinder block that intersects an oil gallery of the cylinder block so that the blind bore of the shaft portion and the interior passage of the tube are in fluid communication with the oil gallery passage of the cylinder block.

In general, a cooling nozzle assembly includes a mounting plate, a pin body and a nozzle tube. The mounting plate has a pin aperture and a fastener aperture. The pin body has a head portion and a shaft portion. The shaft portion of the pin body has a blind bore that extends from an open first end of the shaft portion to the head portion. The shaft portion of the pin body is fitted into the pin aperture of the plate and affixed to the plate. A hole is cross-drilled in the assembly to intersect the blind bore of the shaft portion of the pin body. The nozzle has an interior passage. The nozzle tube is mounted to the plate and pin body assembly by fitting it into the hole. The interior passage is in fluid communication with the blind bore of the pin body. An engine cylinder block includes a cylinder with a piston assembly disposed therein. A mounting surface is provided in the cylinder block for mounting the cooling nozzle assembly proximal to the cylinder. The mounting surface is provided with a pin aperture that intersects with the oil gallery passage of the cylinder block. A fastener aperture is also provided in the mounting surface and is tapped to receive a conventional threaded fastener. The nozzle assembly is mounted to the cylinder block such that the shaft portion of the pin body is disposed in the pin aperture. Thus the blind bore of the shaft portion and the interior passage of the tube are in fluid communication with the oil gallery passage of the cylinder block. The fastener serves both to secure the nozzle assembly to the cylinder block and, in conjunction with the pin body, maintain the radial position of the nozzle assembly in the cylinder block. Accordingly, the nozzle tube is disposed such that the flow of oil is directed to the appropriate areas of the piston.

To acquaint persons skilled in the art most closely related to the present invention, one preferred embodiment of the invention that illustrates the best mode now contemplated for putting the invention into practice is described herein by and with reference to, the annexed drawings that form a part of the specification. The exemplary embodiment is described in detail without attempting to show all of the various forms and modifications in which the invention might be embodied. As such, the embodiment shown and described herein is illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF THE PREFERRED EMBODIMENT

Figure 3:
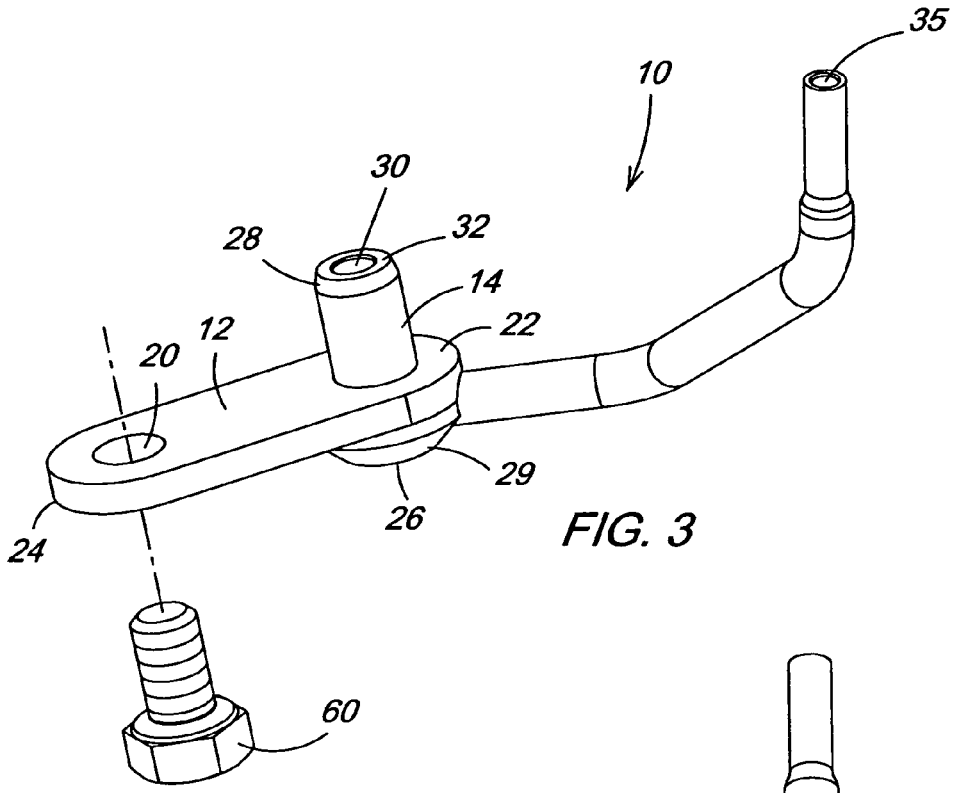
FIG. 3 is a perspective top view of a cooling nozzle according to the invention.
Figure 4:
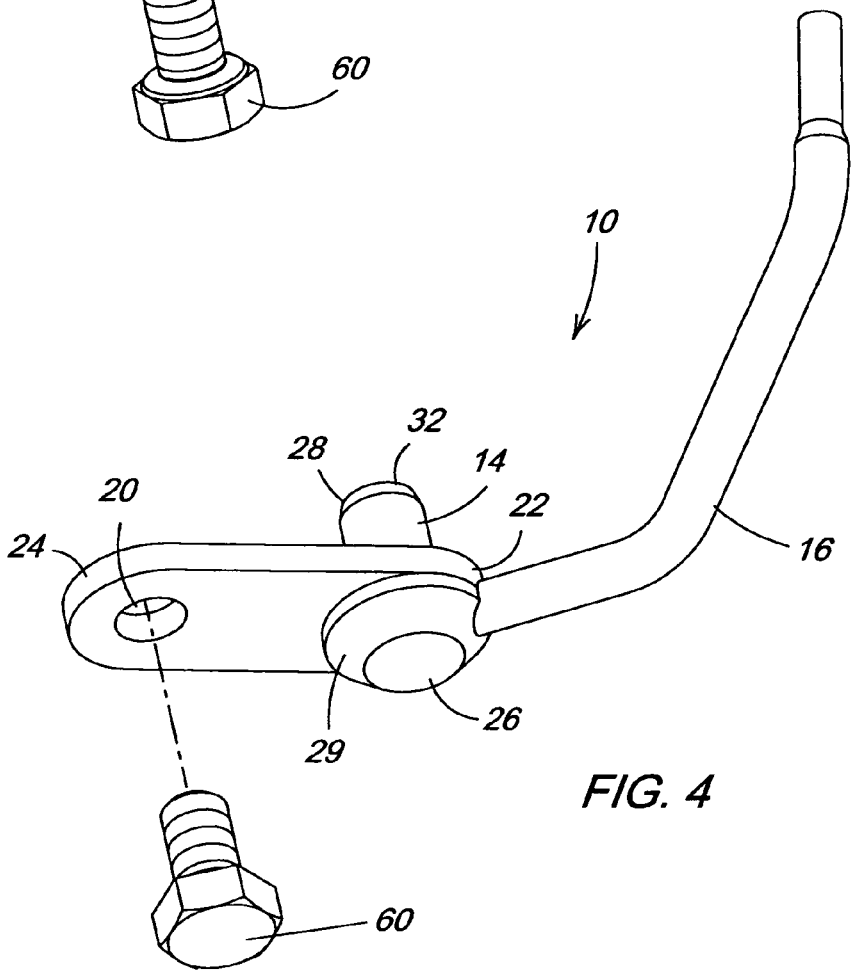
FIG. 4 is a perspective bottom view of a cooling nozzle according to the invention.
Figure 5:
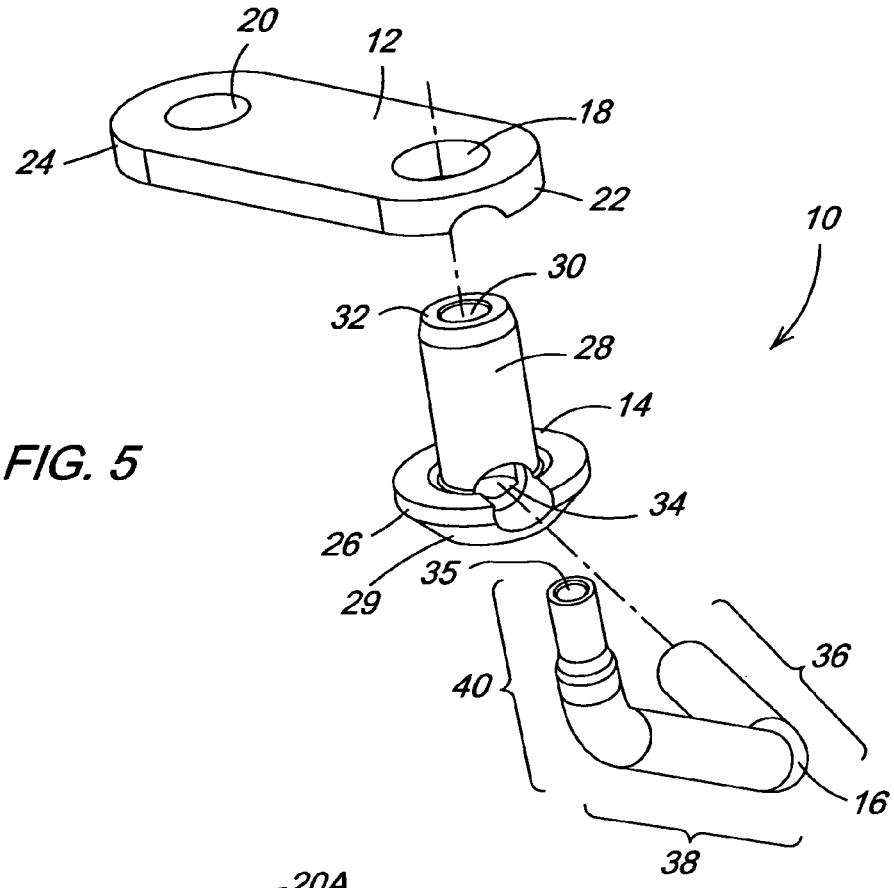
FIG. 5 is an exploded perspective view of a cooling nozzle according to the invention.
Figure 5A:
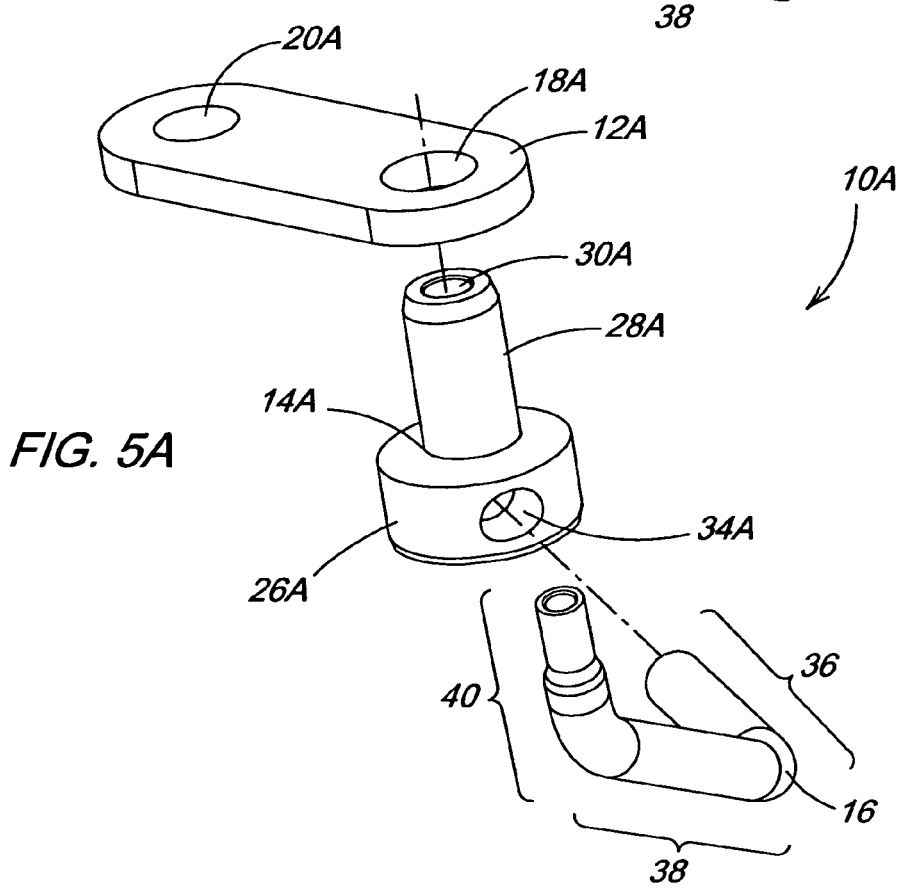
FIG. 5A is an exploded perspective view of a cooling nozzle according to an alternative embodiment of the invention.

With reference now to the drawings and specifically to FIGS. 3–5 it can be seen that a cooling nozzle assembly according to the invention is designated generally by the numeral 10. The nozzle assembly 10 is comprised generally of a mounting plate 12, a pin body 14 and a nozzle tube 16. As can be seen the mounting plate 12 is a flat elongated member having a pin aperture 18 and a fastener aperture 20. The pin aperture 18 is located proximal to a first end 22 of the plate 12 while the fastener aperture 20 is located proximal to a second end 24 of the plate 12. The pin body 14 is a unitary member having a head portion 26 and a shaft portion 28. The shaft portion 28 of the pin body 14 has a blind bore 30 that extends from an open first end 32 of the shaft portion 28 to the head portion 26. As shown, the head portion 26 has a relatively low profile with a peripheral chamfer 29. The shaft portion 28 of the pin body 14 is fitted into the pin aperture 18 of the plate 12 and brazed or otherwise affixed by appropriate means to the plate 12. After the pin body 14 is affixed to the plate 12 a hole 34 is cross-drilled in the assembly to intersect the blind bore 30 of the shaft portion 28 of the pin body 14. The nozzle tube 16 is a unitary tubular member having an interior passage 35 and is defined by three distinct sections. A first end section 36, a midsection 38 disposed at an angle to the first end section 36 and a second end section 40 disposed at an angle to the midsection 38. The nozzle tube 16 is mounted to the plate and pin body assembly by fitting part of the first end section 36 into the hole 34. The nozzle tube 16 is then brazed or otherwise secured to the plate and pin body assembly by appropriate means. Accordingly, the interior passage 35 is in fluid communication with the blind bore 30 of the pin body 14. Although it is preferred, for clearance purposes, to utilize a pin body 14, as described above, with a low-profile head portion 26 and chamfer 29, it may be preferable, depending upon the specific application, to utilize an alternative pin body design. Such an alternative pin body design is illustrated in FIG. 5A. As can be seen, the pin body 14A of nozzle assembly 10A has a larger head portion 26A and no chamfer. With the alternative embodiment of FIG. 5A it is possible within the scope of the invention to provide the cross-drilled hole 34A entirely within the head portion 26A prior to assembly of the pin body 14A to the mounting plate 12A. If the low profile head portion 26 with chamfer 29 of FIG. 5 is not required for clearance purposes, the embodiment of FIG. 5A can provide a simpler, more easily manufactured and less expensive alternative.

Figure 1:
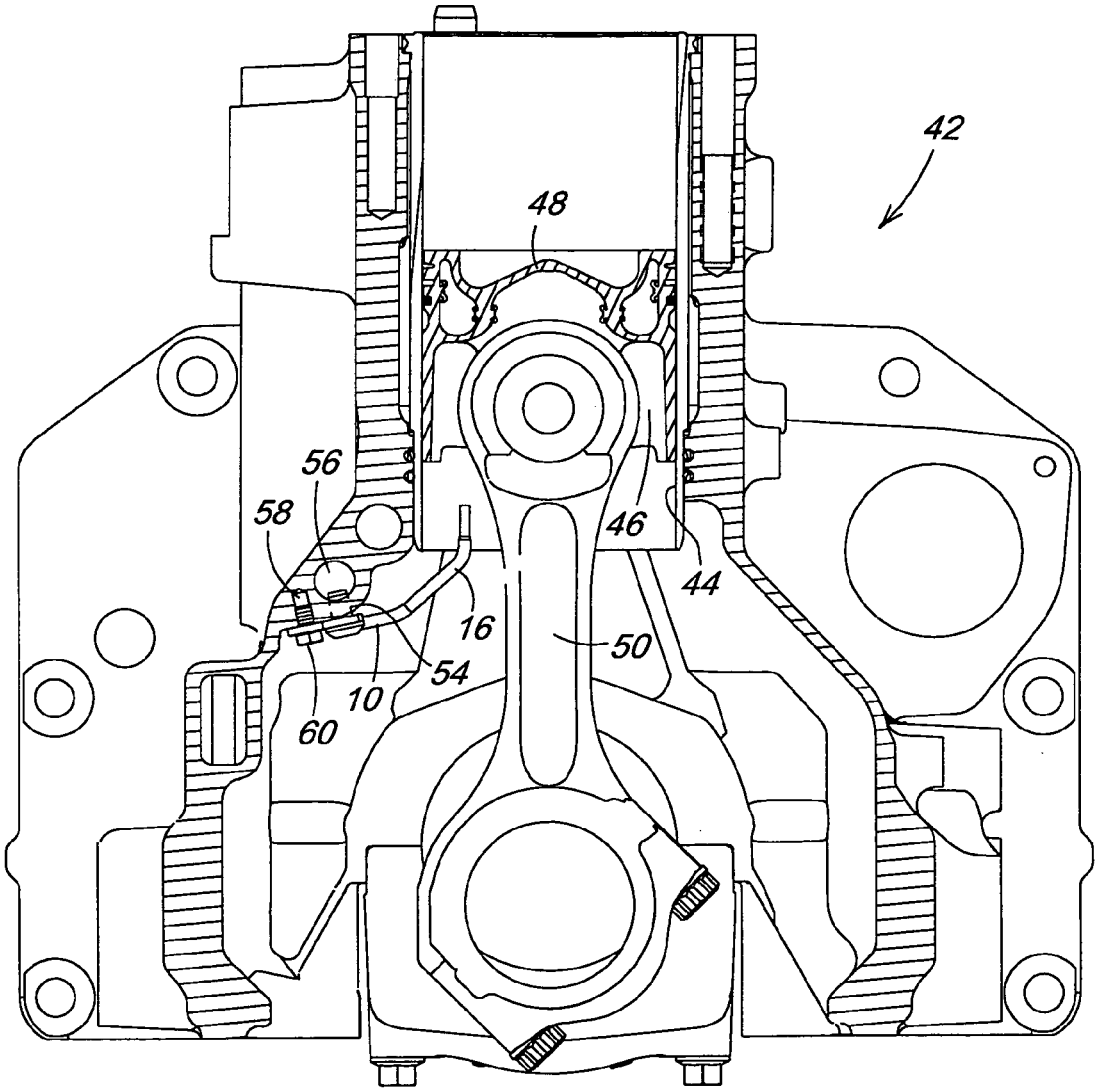
FIG. 1 is a cross-sectional plan view of a portion of an engine cylinder block embodying the mounting arrangement of the invention.
Figure 2:
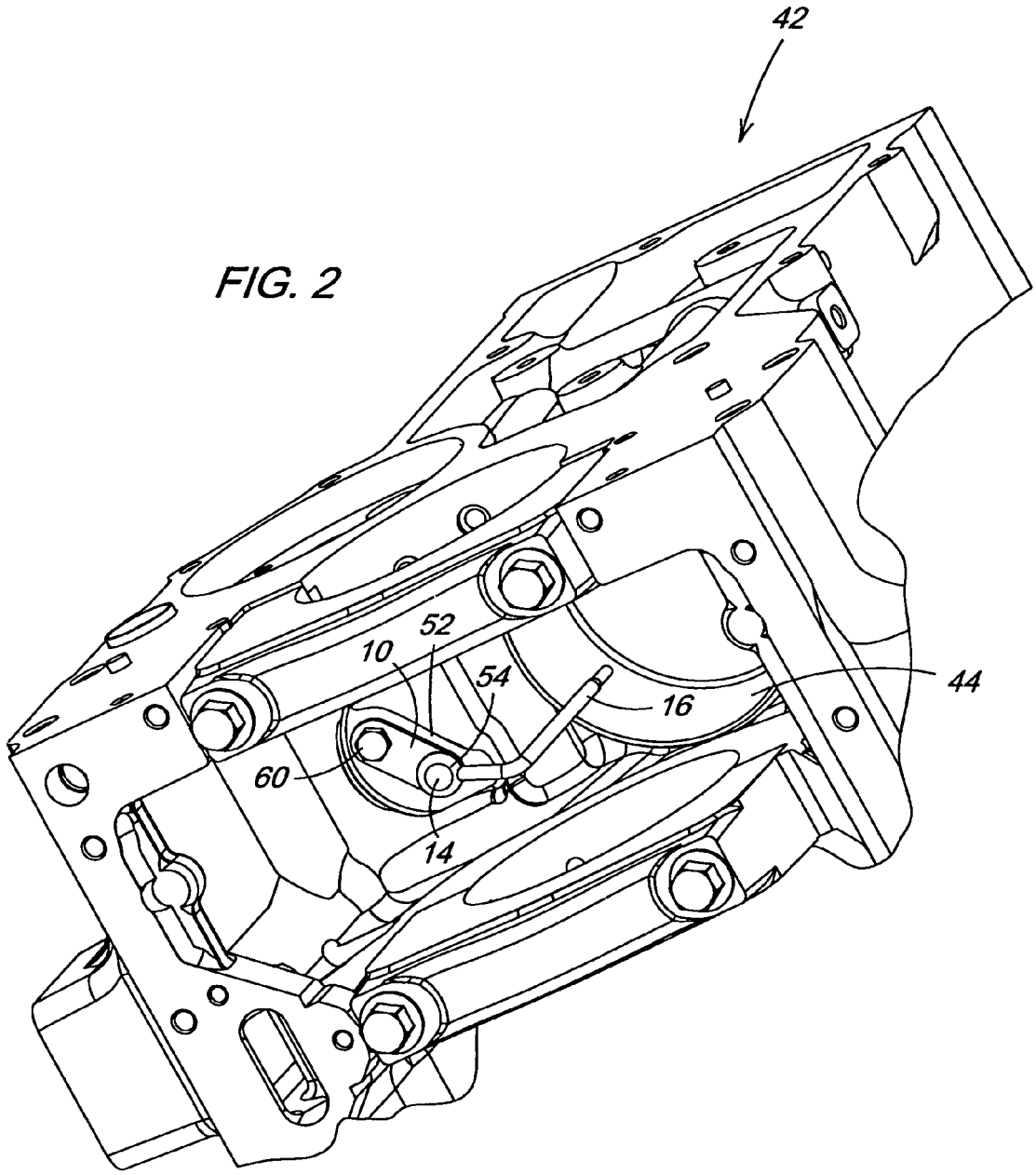
FIG. 2 is a bottom perspective view of a portion of an engine cylinder block embodying the mounting arrangement of the invention.
Figure 6:
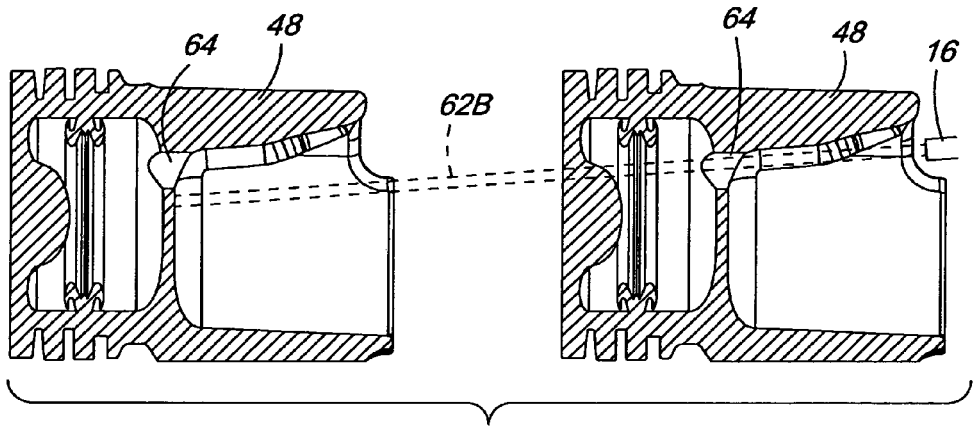
FIG. 6 is a cross-sectional view of a piston in two different stroke positions illustrating an oil flow path according to one embodiment of the invention; and, FIG. 7 is a cross-sectional view of a piston in two different stroke positions illustrating an oil flow path according to another embodiment of the invention.
Figure 7:
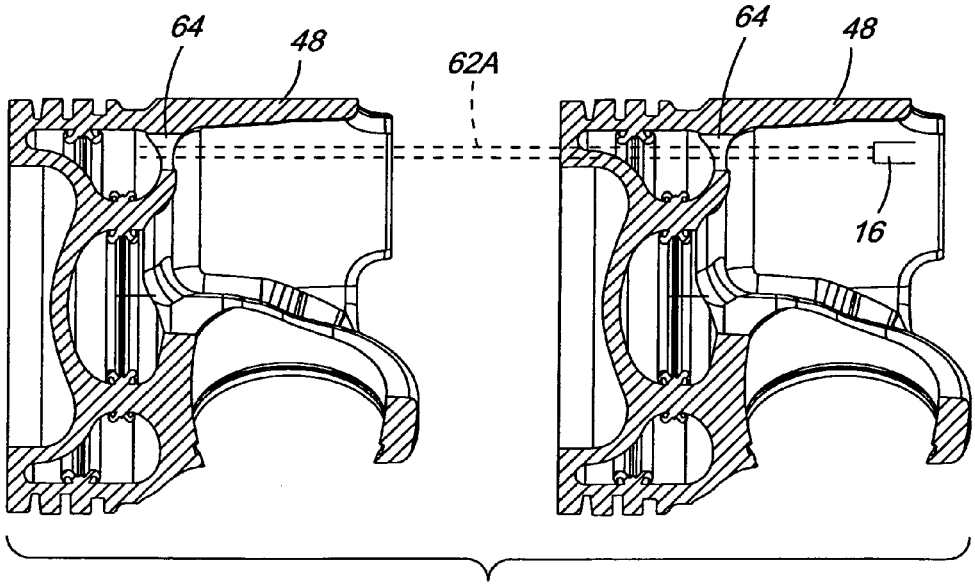

Referring now to FIGS. 1 and 2 an engine cylinder block 42 is illustrated with the cooling nozzle assembly 10 installed therein. The cylinder block 42 includes a cylinder 44 with a piston assembly 46 disposed therein. The piston assembly 46 generally includes a piston 48 and a connecting rod 50. The connecting rod 50 drivingly connects the piston 48 to the crankshaft (not shown) in a conventional manner. A mounting surface 52 is provided in the cylinder block 42 for mounting the cooling nozzle assembly 10 proximal to the cylinder 44. The mounting surface 52 is machined to provide a smooth flat surface on which to mount the nozzle assembly 10. The mounting surface 52 is provided with a pin aperture 54 that intersects with the oil gallery passage 56 of the cylinder block 42. A fastener aperture 58 is also provided in the mounting surface 52. The fastener aperture 58 is tapped to receive a conventional threaded fastener 60. Accordingly, the nozzle assembly 10 is mounted to the cylinder block 42 such that the shaft portion 28 of the pin body 14 is disposed in the pin aperture 54. Thus the blind bore 30 of the shaft portion 28 and the interior passage 35 of the tube 16 are in fluid communication with the oil gallery passage 56 of the cylinder block 42. The fastener 60 engages the tapped fastener aperture 58 of the cylinder block 42 by way of the fastener aperture 20 of the mounting plate 12. The fastener 60 thus serves both to secure the nozzle assembly 10 to the cylinder block 42 and, in conjunction with the pin body 14, maintain the radial position of the nozzle assembly 10 in the cylinder block 42. Accordingly, the nozzle tube 16 is disposed such that the flow of oil is directed to the appropriate areas of the piston 48. More particularly, as shown in FIG. 7 the flow path 62A is directed through an access aperture 64 in the under-crown 66 of the piston 48. Thus oil is directed into the interior of the piston 48. An alternative embodiment is shown in FIG. 6 wherein the second end section 40 of the nozzle tube 16 is angled somewhat differently so as to provide an angular flow path 62B. As illustrated in the drawing this angular flow path 62B intersects the piston 48 at different locations depending on the stroke position of the piston 48 within the cylinder. In the right-hand view of FIG. 6, representing a first stroke position, the flow path 62B is directing oil into the access aperture 64 and thus into the interior of the piston 48. In the left-hand view of FIG. 6, representing a second stroke position, the flow path 62 does not intersect the access aperture 64 so oil is directed onto the underside of the under-crown 66. Accordingly, the cooling nozzle assembly 10 serves to provide an intermittent flow of cooling oil to different parts of the piston 48 as it reciprocates within the cylinder. In the embodiment shown in FIG. 7 the nozzle assembly 10 provides a generally straight flow path 62A into the access aperture 64 regardless of stroke position.

The various angles between the tube sections 36, 38, and 40 serve several purposes. By creating the compound angles it is possible to centrally locate the cooling nozzle assembly 10 in the cylinder block 42 for ready access while still allowing the assembly to communicate with the existing oil gallery passage 56. Further, by utilizing the compound angles it is possible to optimize the flow of oil to the desired areas of the piston and still maintain adequate clearance between the nozzle assembly 10, the piston 48, and the connecting rod 50. Additional clearance may be attained if desired or necessary by providing appropriate relief cuts in the connecting rod. Those having skill in the art will recognize that the specific angles required will vary depending upon a number of factors including the geometry of the specific cylinder block and the specific pistons and connecting rods used.

Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The embodiments of the invention in which an exclusive property or privilege is claimed are defined as follows:

1. A cooling nozzle mounting arrangement comprising:

a cooling nozzle assembly comprised of:

a mounting plate having a pin aperture located proximal to a first end of the plate and a fastener aperture located proximal to a second end of the plate;

a pin body having a head portion and a shaft portion, the shaft portion of the pin body having a blind bore that extends from an open first end of the shaft portion to the head portion wherein the shaft portion of the pin body is fitted into the pin aperture of the plate and affixed to the plate and a hole is cross-drilled in the assembly so as to intersect the blind bore of the shaft portion of the pin body;

a nozzle tube having an interior passage wherein the nozzle tube is mounted to the plate and pin body assembly by fitting a part of the nozzle tube into the hole such that the interior passage is in fluid communication with the blind bore of the pin body;

an engine cylinder block comprised of:

a cylinder with a piston assembly disposed therein, the piston assembly including a piston and a connecting rod, the connecting rod, wherein additional nozzle clearance is attained by providing relief cuts in the connecting rod;

a mounting surface in the cylinder block for mounting the cooling nozzle assembly proximal to the cylinder, the mounting surface having a fastener aperture and a pin aperture that intersects with an oil gallery passage of the cylinder block, wherein the nozzle assembly is mounted to the cylinder block by a fastener that engages both the fastener aperture of the mounting plate and the fastener aperture of the cylinder block such that the shaft portion of the pin body is disposed in the pin aperture so that the blind bore of the shaft portion and the interior passage of the tube are in fluid communication with the oil gallery passage of the cylinder block.

* * * * *